US005779143A

United States Patent [19]

Michaud et al.

[11] Patent Number: 5,779,143

[45] Date of Patent: Jul. 14, 1998

[54] ELECTRONIC BOILER CONTROL

[75] Inventors: Roger P. Michaud, Orrs Island, Me.; Larry Milesky, Needham, Mass.

[73] Assignee: Erie Manufacturing Company, Milwaukee, Wis.

[21] Appl. No.: 800,193

[22] Filed: Feb. 13, 1997

[51] Int. Cl.[6] ..... F24D 3/00

[52] U.S. Cl. ..... 237/8 R; 237/56

[58] Field of Search ..... 237/8 R, 56

[56] References Cited

U.S. PATENT DOCUMENTS

| | | | |
|---|---|---|---|
| 3,421,691 | 1/1969 | Forbes . | |
| 4,071,745 | 1/1978 | Hall | 364/104 |
| 4,470,541 | 9/1984 | Raleigh . | |
| 4,479,881 | 10/1984 | Uhrich . | |
| 4,690,324 | 9/1987 | Kasaprzyk . | |
| 4,844,335 | 7/1989 | Mckinley et al. . | |
| 4,978,063 | 12/1990 | Chase . | |
| 5,024,265 | 6/1991 | Buchholz et al. . | |
| 5,050,725 | 9/1991 | Butler . | |
| 5,056,712 | 10/1991 | Enck . | |
| 5,118,039 | 6/1992 | Williams, Jr. . | |
| 5,190,215 | 3/1993 | Habermehl, Jr. et al. . | |
| 5,245,835 | 9/1993 | Cohen et al. . | |
| 5,337,955 | 8/1994 | Burd . | |
| 5,617,994 | 4/1997 | Fiedrich | 237/8 R |
| 5,622,221 | 4/1997 | Genga, Jr. et al. | 165/208 |

*Primary Examiner*—Henry A. Bennett
*Assistant Examiner*—Derek S. Boles
*Attorney, Agent, or Firm*—Andrus, Sceales, Starke & Sawall

[57] ABSTRACT

A hydronic heating system including a single self-contained hydronic control unit. The hydronic control unit allows for zoned heating operation in which a series of individual room thermostats and zone valves control the flow of heated water into each of the heating zones. The hydronic control unit operates an oil or gas fired boiler to maintain boiler water temperature at a selected value. The hydronic control unit includes a priority terminal which can be connected to a priority heating zone, such as an indirect fired water heater. Upon receiving a demand for heat from the priority heating zone, the hydronic control unit diverts the flow of heated water from the boiler to the priority zone exclusively. The hydronic control unit further includes a terminal for connection of an outdoor air sensor. In cooperation with the outdoor air sensor, the hydronic control unit can operate in a boiler reset operating mode such that the boiler temperature is related to the outside air temperature. The hydronic control unit includes a terminal for connection of a hot water sensor, which is also connected to a safety terminal. The hot water sensor indicates the temperature of water in the boiler, and provides a safety switch should the water in the boiler exceed an upper limit. The hydronic control unit further includes connection for a low water cut-off probe that interrupts the power to the hydronic control unit should the quantity of water in the hydronic heating system fall below a minimum value. The hydronic control unit incorporates the above-identified features in a single control housing, such that only one power connection is needed for the above-identified features.

24 Claims, 5 Drawing Sheets

ELECTRONIC BOILER CONTROL

BACKGROUND OF THE INVENTION

The invention relates to a hydronic heating system. More specifically, the invention relates to a boiler controller for a gas or oil fired boiler used in a hydronic heating system having a plurality of heating zones and an indirect fired water heater.

Oil and gas fired boilers have long been used to supply hot water for hydronic heating in a residential building. Conventional hydronic heating systems circulate a supply of heated water through a series of heat exchangers positioned in the individual rooms of the residential building.

A simple hydronic heating system consists of a single boiler and circulating pump that are controlled by a control unit which responds to a demand for heat from a single room thermostat. Thus, the single room thermostat only allows one temperature to be specified by the homeowner. The temperature in the vicinity of the thermostat will be controlled to the desired level, but in other parts of the house, the temperature can vary widely due to inadequate air distribution, solar radiation entering through outside windows, outside wind, and heat generated by people and other appliances. In response to these problems and the desire for greater comfort and flexibility, zoned heating systems have been developed.

A zoned heating system divides a building into a series of heating zones, each of which has an individual thermostat and flow control means, such as a valve. The zoned heating system is advantageous in that the homeowner can selectively determine the temperature in the different heating zones, which results in increased energy savings since the homeowner is able to divert an increased amount of heat into the occupied rooms.

In a hydronic heating system incorporating separate heating zones, a boiler control unit is typically provided to operate the boiler between upper and lower temperature limits to maintain the temperature of the water in the boiler. The boiler controller typically also controls the operation of a circulating pump based on heating demand signals from the plurality of room thermostats. To accomplish the zoning, a separate relay package is connected to the boiler controller for operating a series of zone valves to divert the flow of water from the boiler to the individual heating zones. Typically, the relay package is separate from the control unit which operates the boiler. Since the boiler control unit and the relay package required for zoning are separate components, separate external wiring is needed for each of the individual components. In practice, this requires an electrician to install the relay package, which is often a costly procedure.

In zoned hydronic heating systems, a series of electronically operated valves are used to control the flow of the heated water from the boiler to each of the heating zones. In this type of system, the boiler control unit operates the circulating pump, while the separate relay package provides the high voltage to operate the valves to direct the flow of heated water from the boiler. As previously mentioned, since the relay package is not integrally formed with the boiler control unit, it must be separately wired during construction of the house, or at a later time.

In addition to controlling the flow of heated water to each of the heating zones, many present-day hydronic heating systems include an indirect fired water heater such that a single gas or oil fired boiler can be used for both residential space heating and the production of domestic hot water. An indirect fired hot water heater typically includes a heat exchanger within a water tank that is in direct contact with the water contained therein. High temperature water generated in the boiler is circulated through the heat exchanger to raise the water temperature contained in the indirect water heater tank, thereby producing domestic hot water. When heated water from the indirect water heater is drawn down and replaced by cold makeup water, a thermostat in the water heater demands high temperature water from the single boiler. Since the output of the boiler is shared with the residential heating load, there can be times when the demand for high temperature water for the water heater exceeds the available supply. Thus, the recovery rate or the time required to heat up the water in the indirect water heater to the temperature set by the thermostat will be longer than when a boiler is dedicated solely to the water heater. Consequently, inconvenience due to the lack of an adequate amount of hot water may be experienced in the household.

In recent years, several advances have been made to increase the operating efficiency of hydronic heating systems. For instance, a control package which modifies the operating water temperature in the boiler based on the outside air temperature can be connected to the boiler control unit. This additional control package, referred to as a boiler reset feature, reduces the water temperature in the boiler when the outside air temperature increases, since the demand for heating has decreased. Typically, the boiler reset package is external from the boiler control unit and requires separate power connections, thereby requiring trained personnel, such as an electrician, in order to connect to the boiler controller.

The combination of the boiler control unit, relay package, and boiler reset control package work well in controlling and distributing hot water from the single boiler, but the combination requires external wiring which can be quite expensive. The increased expense is dictated by the additional skilled labor and the fact that each of the controllers is independent from one another and contains its own power transformers and circuitry, which is oftentimes redundant. Therefore, it can be appreciated that a single boiler control unit which performs at least all of the above-identified functions and is contained in a single package would be a desirable improvement in the field of hydronic heating.

SUMMARY OF THE INVENTION

It is an object of the invention to provide a single hydronic control unit which performs a variety of desirable boiler functions and is contained in a single package having a single power connection. It is a further object of the invention to provide a hydronic heating system which contains a single hydronic control unit capable of operating a series of zone valves in response to operating signals from a series of zone thermostats, such that the hydronic control unit is capable of providing zoned heating. It is a further object of the invention to provide a hydronic control unit which can maintain the temperature of a gas or oil fired boiler between an upper limit and a lower limit. It is a further object of the invention to provide an hydronic control unit capable of designating a priority heating zone, such that upon receipt of a heating demand signal from the priority zone, the hydronic control unit diverts the entire flow of heated water from the boiler to the priority zone. It is another object of the invention to provide a hydronic control unit which receives the outdoor air temperature and selectively modifies the boiler operating temperature based on the outdoor air sensor. It is another object of the invention to provide a hydronic control unit which prevents the circulation of heated water throughout the house when the outdoor air temperature exceeds a set value. It is another object of the invention to provide a safety cut-out such that, should the water temperature in the boiler exceed an upper limit, or if the amount of water in the hydronic heating system falls below a minimum amount, the safety cut-out removes power to the hydronic control unit.

The hydronic heating system of the invention includes a single hydronic control unit having a single high voltage power connection. The hydronic control unit is connected to a series of zone valves and room thermostats. A single zone valve and a single room thermostat are each designated to a specific room or area in the house, such that the series of zone valves and room thermostats divide the house into heating zones. Through the zone valves and room thermostats, the hydronic control unit can selectively control the flow of heated water to each individual heating zone in the house.

The hydronic control unit is also connected to a priority aquastat and a priority circulating pump. Upon receiving a heating demand signal from the priority aquastat, the hydronic control unit of the invention diverts the entire flow of heated water from the boiler to the priority heating zone. Typically, the priority aquastat is connected to an indirect domestic hot water heater. Once the demand for heat from the priority aquastat has been satisfied, the hydronic control unit directs the flow of heated water from the boiler to the other heating zones requesting heat.

A hot water sensor is connected to a pair of terminals on the hydronic control unit such that the hydronic control unit receives information concerning the temperature of the water in the boiler. The hot water sensor also includes a safety switch such that, should the water temperature in the boiler exceed an upper safety limit, the hot water sensor becomes an open switch, thereby interrupting power to the burner. Preferably, the hydronic control unit further includes a low water cut-off probe such that, should the volume of water in the hydronic heating system fall below a lower limit, the low water cut-off probe interrupts power to the hydronic control unit.

The hydronic control unit of the invention is operable in a standard mode, a boiler reset mode, and a cold start mode. In the standard operating mode, the hydronic control unit maintains the boiler water temperature above a lower temperature limit. Upon a demand for heat from any one of the heating zones, or the priority zone, the hydronic control unit operates the boiler to increase the boiler water temperature to the upper limit. The hydronic control unit operates a circulating pump to circulate the supply of heated water to the heating zone requiring heat as long as the boiler temperature is above the lower temperature limit.

In the standard operating mode, the hydronic control unit also includes a warm weather cut-out feature. When the warm weather cut-out feature is selected, the hydronic control unit will no longer operate the circulating pump if the temperature of the outside air exceeds a set value, since the outside air temperature dictates that heating is not required.

In the boiler reset operating mode, the hydronic control unit will maintain the boiler water temperature at a desired value. The hydronic control unit will modify the desired boiler water temperature based on the outside air temperature. Thus, as the outside air temperature increases, the boiler water temperature decreases, since the demand for heat is reduced. A ratio selector switch is included on the hydronic control unit, such that the ratio between the change of the boiler water temperature and the outdoor air temperature can be selected.

In the cold start mode, the hydronic control unit permits the boiler water temperature to regulate at the lower temperature limit. Upon a demand for heat from one of the heating zones, the hydronic control unit operates the boiler to increase the boiler water temperature to the upper limit before it is circulated throughout the house.

The hydronic control unit of the invention contains a single high voltage connection. The room thermostats, the zone valves, the priority aquastat, the outdoor air sensor, the hot water sensor, and the low water cut-off probe can all be connected to the hydronic control unit without any high voltage connections.

Other features and advantages of the invention will be apparent in the following description.

BRIEF DESCRIPTION OF THE SEVERAL VIEWS OF THE DRAWINGS

The drawings illustrate the best mode presently contemplated of carrying out the invention.

In the drawings.

DETAILED DESCRIPTION OF THE INVENTION

Figure 1:
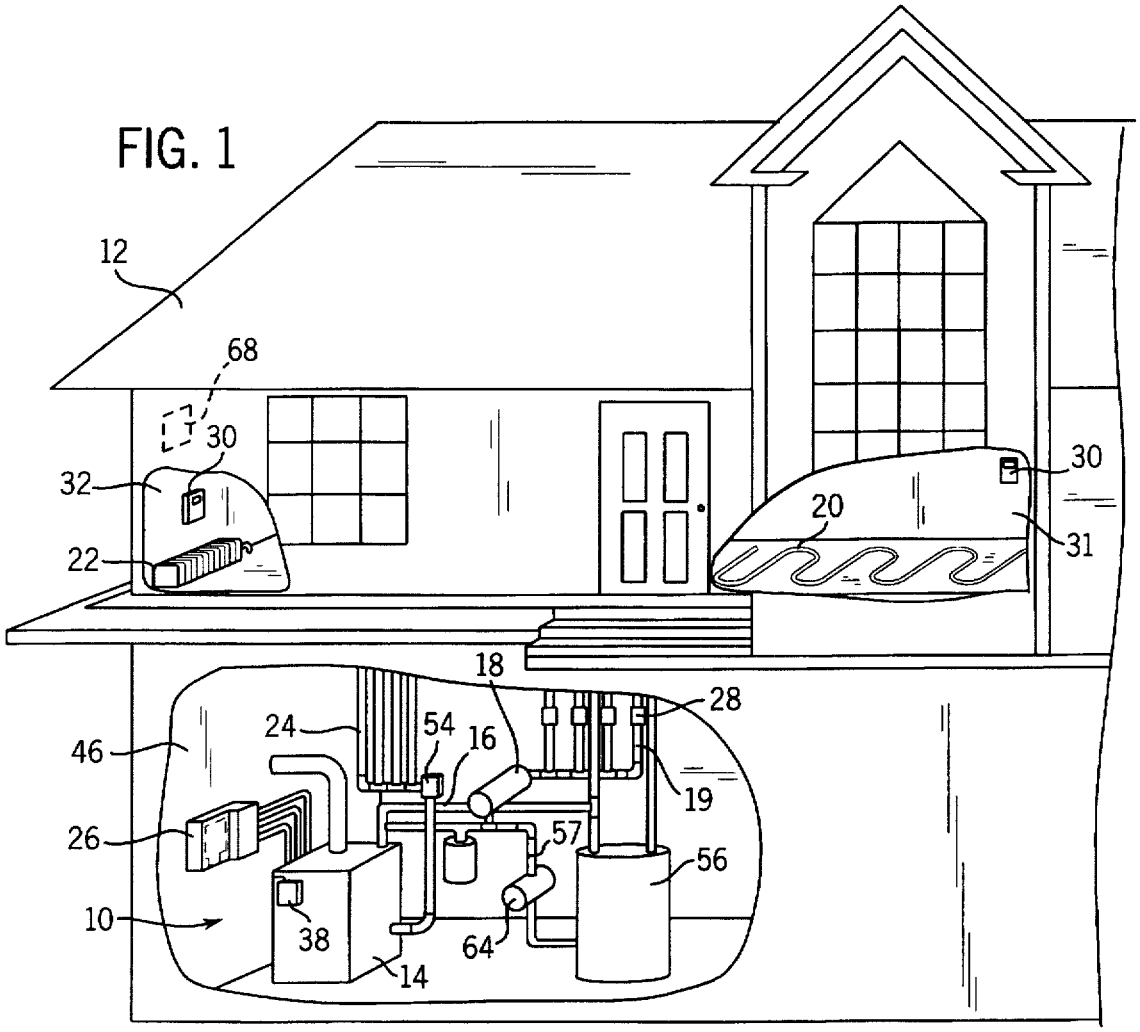
FIG. 1 is a perspective view showing the hydronic heating system, including a hydronic control unit, of the invention as installed in a residential building.

FIG. 1 shows a hydronic heating system 10 that provides heat for a residential building, such as house 12. The hydronic heating system 10 circulates a supply of heated water through a series of heat exchangers positioned throughout the house 12. The heat exchangers positioned throughout the house radiate heat from the heated water to warm the interior space of the house 12 to a desired temperature. Thus, through the circulation of heated water, the occupants of the house 12 are able to control the interior temperature.

The hydronic heating system 10 includes a single gas or oil fired boiler 14 that is used to heat the supply of water circulated throughout the house 12. The heated water from boiler 14 flows out through outlet pipe 16 and is pumped throughout the house 12 by a conventional circulating pump 18. The heated water leaving the circulating pump 18 is pumped via supply pipes 19 throughout the house 12, where it enters one of a variety of types of heat exchangers, such as a radiant floor heater 20 or a baseboard heater 22. After the heated water from the boiler 14 has traveled through the radiant floor heater 20 and the baseboard heater 22, it returns to the boiler 14 through a series of return pipes 24. The return water then reenters the boiler 14 where it is reheated and again circulated throughout the house 12. In this manner, the supply of water stores the heat from boiler 14 and releases the heat into the interior of the house 12 to provide the desired heating.

Figure 2:
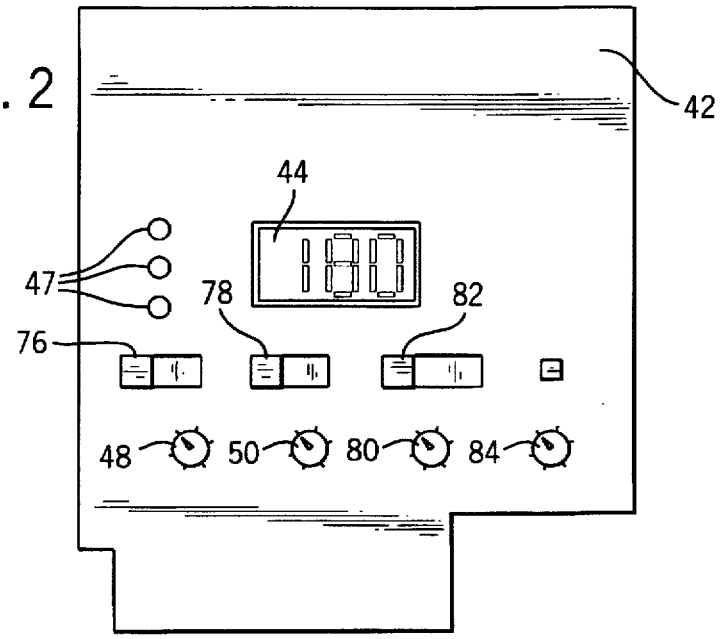
FIG. 2 is a front view showing the display panel of the hydronic control unit incorporated into the hydronic heating system of FIG. 1.

The hydronic heating system 10 is controlled by a single hydronic control unit 26 which performs a variety of functions to be described in detail below. The hydronic control unit 26 contains a single high voltage connection at a pair of power terminals 27, as shown in FIG. 2. In the preferred embodiment, the power terminals 27 are connected to a supply of 120 volt AC power. A power transformer (not shown) in the hydronic control unit 26 is connected to the power terminals 27 to step down the high voltage power supply. Additionally, the power transformer provides the required power to drive a series of valves to be described below.

Figure 3:
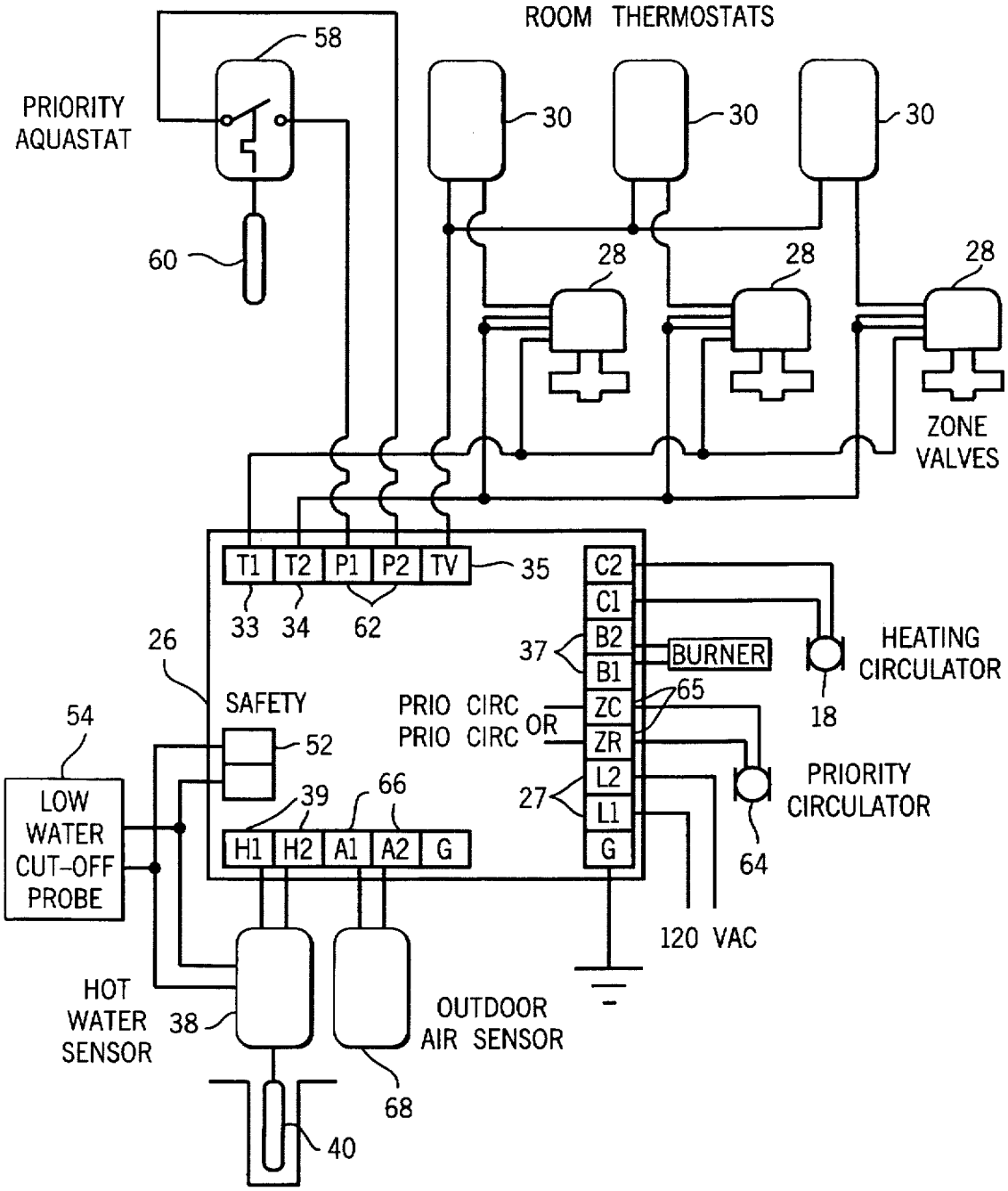
FIG. 3 is a schematic wiring diagram showing interconnection of representative components of the hydronic heating system of FIG. 1, including a hydronic control unit, for a residential building having a plurality of heating zones.

In the first embodiment of the hydronic heating system 10, shown in FIGS. 1 and 3, the hydronic control unit 26 is electronically connected to a series of zone valves 28, each of which are connected to an individual room thermostat 30. In the embodiment shown in FIGS. 1 and 3, the house 12 is divided into a series of "heating zones", each of which has its own zone valve 28 and room thermostat 30. In this manner, the occupant of the house 12 can set the temperature in each of the heating zones to a different reading based on the desired amount of heat required in each area. For example, in a first heating zone 31, which may be a dining room for example, the user can set the temperature at the room thermostat 30 to an elevated value when the occupant is using that heating zone. Likewise, the thermostat 30 in a second heating zone 32, such as a bedroom, can be set at a lower value when the occupants are not in that room. In this manner, the occupant of house 12 can increase the efficiency of the hydronic heating system 10 by only providing heat to the heating zones which need it.

As can be seen in FIG. 3, each of the zone valves 28 is connected to a pair of terminals 33 and 34 on the hydronic control unit 26. Each of the room thermostats 30 is connected to one of the zone valves 28 and to a terminal 35 on the hydronic control unit 26. In operation, the desired temperature for each the heating zone is set at the room thermostat 30 contained in the heating zone. When the temperature in the heating zone falls below the temperature set on the room thermostat 30, the thermostat 30 sends out a demand signal to terminal 35 on the hydronic control unit 26. When the hydronic control unit 26 receives a demand signal from any one of the room thermostats 30, the control unit 26 opens the corresponding zone valve 28 and turns on the circulating pump 18. The circulating pump 18 pulls the heated water from the boiler 14 through the outlet pipe 16, where it is then distributed to the heating zones through the zone valves 28.

As can be seen in FIG. 3, the single hydronic control unit 26 is also connected at a pair of terminals 37 to a burner 36 contained in the boiler 14. Through this connection, the hydronic control unit 26 can control the operation of the burner 36 and thus control the temperature of the water within the boiler 14. The hydronic control unit 26 monitors the temperature of the water within the boiler 14 through a hot water sensor 38 connected between a pair of terminals 39. The hot water sensor 38 includes a temperature probe 40 which extends into the supply of water contained within the boiler 14. In the preferred embodiment of the invention, the temperature probe 40 is a thermocouple wire that extends into the body of water in the boiler 14. Through the use of the hot water sensor 38, the hydronic control unit 26 operates the burner 36 to maintain the water temperature within the boiler at a desired value.

Shown in FIG. 2 is the display face 42 of the hydronic control unit 26. The display face 42 includes a digital display 44 having an LED readout. The digital display 44 shows the actual boiler water temperature measured by the hot water sensor 38 and provides a clear indication of the boiler water temperature in dark operating environments, such as basement 46. A series of LED's 47 contained on the display face 42 show calls from the burner 36, circulating pump 18 and a priority device. Also included on the display face 42 are a high limit dial 48 and a low limit dial 50 which are used to set the operating parameters for the boiler 14. The high limit dial 48 contains a series of markings corresponding to a range of possible temperatures. In the preferred embodiment of the invention, the high limit dial 48 has settings of 120° F., 160° F., 180° F., 200° F., and 220° F. The low limit dial 50 has settings of 120° F., 140° F., 160° F., 180° F. and 200° F., along with a cold start setting of 90° F. For the hydronic control unit 26 to operate properly, the high limit dial 48 must be set at least 20° F. higher than the low limit dial 50. The operation of the hydronic control unit 26 in maintaining the boiler temperature will be discussed in greater detail below.

The hot water sensor 38 is also connected to a pair of safety terminals 52 on the hydronic control unit 26. The safety terminals 52 are positioned in series with the secondary terminal of the power transformer (not shown) contained within the hydronic control unit 26. The power transformer provides the required electricity to operate the entire hydronic heating system 10. In addition to sensing the water temperature in the boiler 14, the hot water sensor 38 acts as a safety relay. If the water temperature in the boiler 14 exceeds an upper safety limit, a relay in the hot water sensor 38 opens, thereby disrupting the supply of power to the burner 36 and preventing the further operation of burner 36 in the boiler 14. Thus, the hot water sensor 38 acts as a safety limiter by removing power to the burner 36 should the water temperature in the boiler 14 exceed a selected upper safety limit.

In addition to the hot water sensor 38, a low water cut-off probe 54 is connected to the safety terminals 52. The low water cut-off probe 54 is shown in FIG. 1 between the return pipes 24 and the boiler 14. The low water cut-off probe 54 monitors the amount of water in the circulating path between the boiler 14 and the series of heat exchangers located in the house 12. If the amount of water in the circulating path drops below a minimum level, the low water cut-off probe 54 opens, thereby disrupting the supply of power to the hydronic control unit 26.

In the embodiment of the hydronic system 10 shown in FIGS. 1 and 3, an indirect water heater 56 is connected to the boiler 14 by water line 57. The indirect water heat includes an outer jacket through which the heated water from boiler 14 passes. A heat exchanger is contained within the water heater 56 and is in communication with both the heated water in the outer jacket and the water within the heater 56. The heat carried in the water from the boiler 14 is transferred to the water contained within the indirect water heater 56 to raise the temperature of the water in the water heater 56.

The temperature of the water in the indirect water heater 56 is controlled by a priority aquastat 58, FIG. 3, which includes a temperature probe 60. When the water temperature in the indirect water heater 56 falls below a specified value, the priority aquastat 58 sends a demand signal to the hydronic control unit 26 through a pair of terminals 62. When the hydronic control unit 26 receives such a signal from the priority aquastat 58, the hydronic control unit 26 turns on a priority circulating pump 64 connected to terminals 65. Since hot water from the indirect water heater 56 is a priority in residential housing, the aquastat 58 is designated as a "priority zone". When the hydronic control unit 26 receives a demand signal from the "priority zone", the control unit 26 turns off the circulating pump 18, thereby diverting the entire flow of heated water from the boiler 14 to the water heater 56 connected to the priority zone. Once the priority aquastat 58 has been satisfied and no longer requires the supply of heated water, the control unit 26 turns "off" the priority circulating pump 64 and turns "on" the circulating pump 18 to supply the other heating zones with heated water. Although the hydronic heating system 10 has been discussed as having an indirect fired water heater 56 connected as the "priority zone", the "priority zone" could be designated as a specific room in the house, such that upon demand for heat in that room, the flow of heated water to all other rooms is diverted until the demand for hot water in the priority zone is satisfied.

The hydronic control unit 26 includes a pair of terminals 66 which can be connected to an outdoor air sensor 68. The outdoor air sensor 68 is mounted on the outside of the house 12, preferably along a northern exposure, such that the outdoor temperature sensor 68 relays the outdoor temperature to the hydronic control unit 26. In the preferred embodiment of the invention, the outdoor air sensor 68 is a standard component such as Part No. OAS-01 sold by Erie Controls. The outdoor air sensor 68 provides a temperature signal which is used when the hydronic control 26 is operating in the boiler reset mode and the cut-off mode, to be discussed in detail below.

Figure 4:
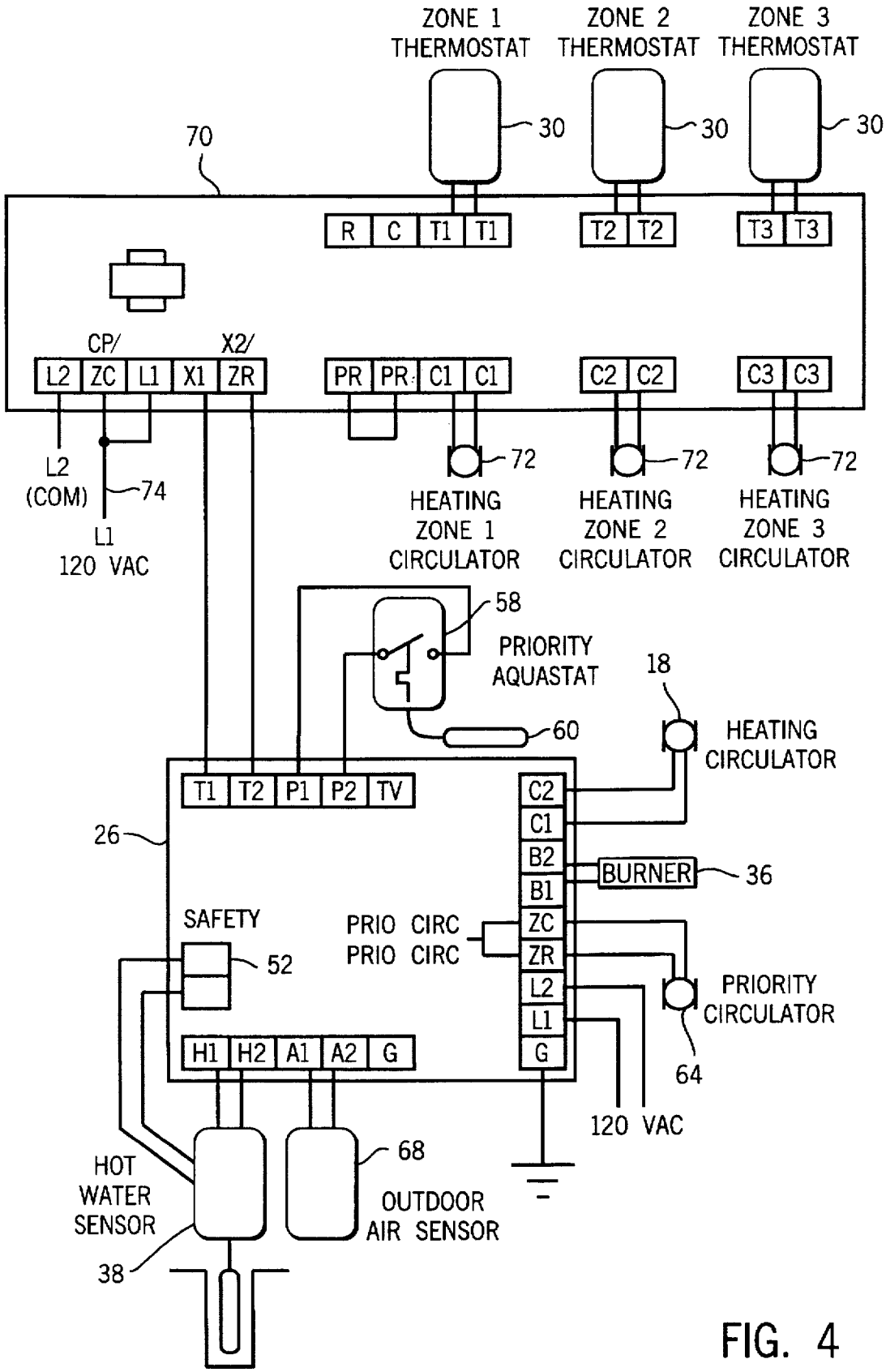
FIG. 4 is a schematic wiring diagram similar to FIG. 3 showing a hydronic heating system, including a hydronic control unit, for a residential building having a plurality of heating zones and heating circulators.

Shown in FIG. 4 is a second configuration for the hydronic heating system 10. In this configuration, the hydronic control unit 26 is connected to an external relay block 70, such as Part No. SR-301 sold by Erie Controls. The relay block 70 contains the connections for the individual room thermostats 30 such that the room thermostats 30 are not connected directly to the hydronic control unit 26. Unlike the first embodiment shown in FIG. 3, the embodiment of FIG. 4 does not include a zone valve 28 for each of the room thermostats 30. Instead, each of the heating zones includes its own circulating pump 72. Thus, when the hydronic control unit 26 receives a demand for heat from one of the room thermostats 30, instead of opening or closing a zone valve 32, the control unit 26 signals the relay block 70 to operate the appropriate individual circulating pump 72. The relay block 70 includes a separate power connection 74 which must be individually wired. The remaining components connected to the terminals of the hydronic control unit 26 remain the same as in the configuration of FIG. 3, and similar reference numerals are used to facilitate understanding.

Figure 5:
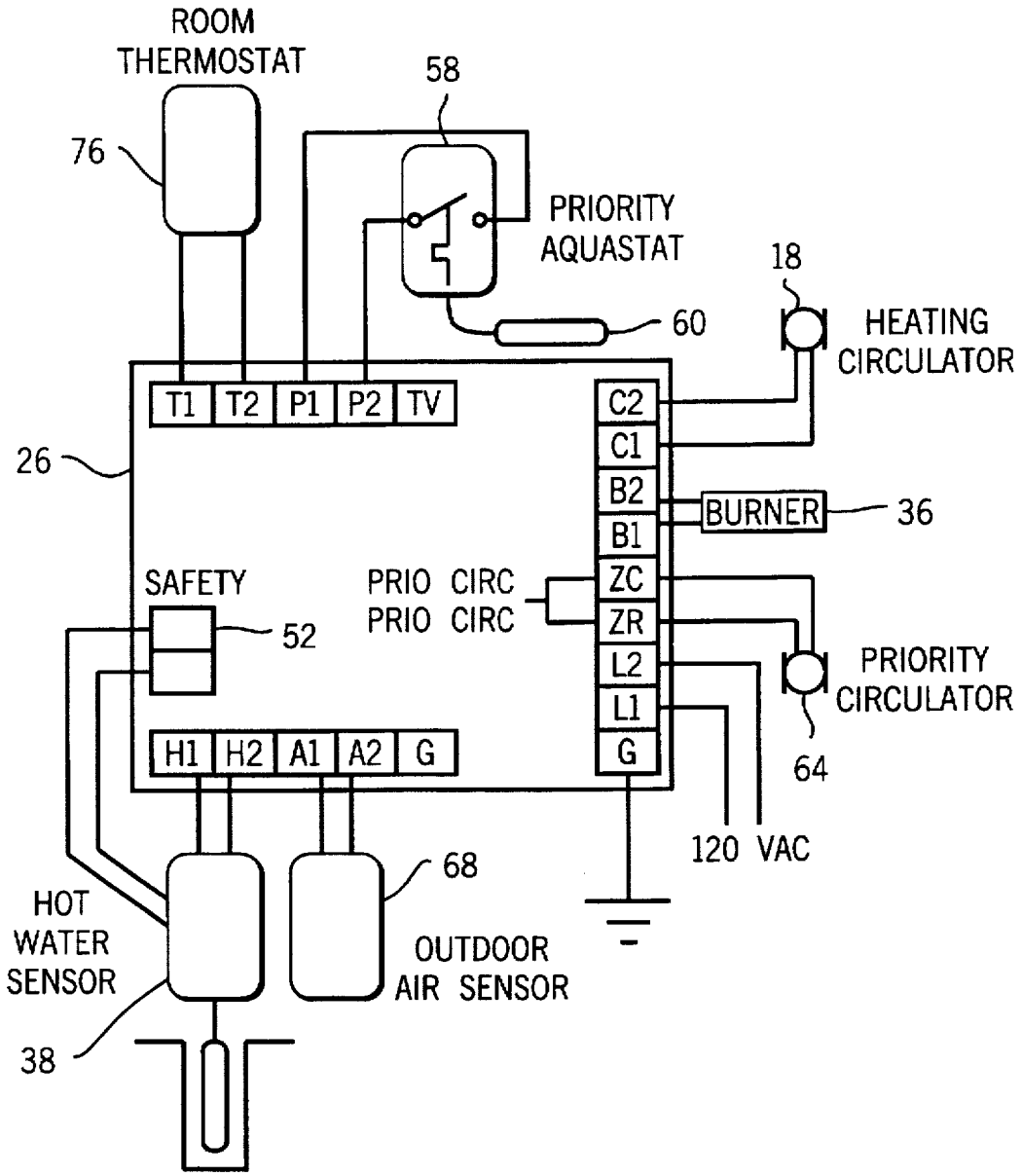
FIG. 5 is a schematic wiring diagram similar to FIGS. 3 and 4 showing a hydronic heating system, including a hydronic control unit, for a residential building having a single heating zone.

Referring now to FIG. 5, a third embodiment of the hydronic heating system 10 is shown incorporating the hydronic control unit 26. In the embodiment shown in FIG. 5, the individual room thermostats 30 for each heating zone are replaced by a single room thermostat 76, such that the hydronic heating system 10 responds to the temperature at a single location within the house 12. The remaining components connected to the hydronic control units 26 remain the same as in the configuration of FIG. 3, and similar reference numerals are used to facilitate understanding.

The operation of the hydronic control unit 26 in controlling the hydronic heating system 10 will now be discussed in greater detail with particular reference being made to the first embodiment shown in FIGS. 1–3, with the understanding that the embodiments of FIGS. 4 and 5 operate in a similar manner. Initially, the hydronic control unit 26 is mounted to a suitable surface, such as the basement wall shown in FIG. 1. Once the hydronic control unit 26 is connected to a high voltage source at power terminals 27, the individual connections to the circulating pump 18, zone valves 28, room thermostats 30, hot water sensor 38, low water cut-off probe 54, priority aquastat 58, priority circulator 64, and outdoor air sensor 68 can all be made without the requirement of any additional high voltage connections, thereby eliminating the need for a specially trained electrician. That is, a licensed electrician makes the high voltage connection at power terminals 27 and the remaining low-voltage connections can then be made by a person other than a licensed electrician, such as an HVAC contractor when installing the system components or by the homeowner when replacing or retrofitting certain components of the system. Once all the external connections are made to the hydronic control unit 26, the specific settings for the hydronic control unit 26 are made.

The hydronic control unit 26 can operate in three separate modes; a standard mode, a boiler reset mode, and a cold start mode. The selection of each mode is determined by a mode selection switch 76 shown in FIG. 2. When the mode selection switch 76 is in its leftmost position, the hydronic control unit 26 operates in the standard, or fixed set point mode. When the hydronic control unit is in the standard operating mode, an upper temperature limit is set by the high limit dial 48 and a lower temperature limit is set by the low limit dial 50. In this mode, the hydronic control unit 26 emulates a standard triple duty aquastat by establishing the boiler water upper and lower temperature limits.

Upon demand from heat from any one of the room thermostats 30, the hydronic control unit 26 will turn on the burner 36 until the boiler water temperature reaches the upper temperature limit set by high limit dial 48. If the water temperature is above the lower limit, the hydronic control unit 26 activates the circulating pump 18 to circulate the heated water through the heat exchangers positioned in each of the heating zones throughout the house 12. If the demand for heat continues, the hydronic control unit 26 will turn on the burner 36 when the boiler water temperature drops 15° F. below the upper temperature limit. A differential jumper (not shown) contained in the hydronic control unit 26 can be removed such that the water temperature will drop 30° F. from the upper temperature limit before the burner 36 is fired by the hydronic control unit 26.

When none of the heating zones are calling for heat, the hydronic control unit 26 will turn on the burner 36 when the water temperature falls 15° F. below the lower temperature limit set by the low limit dial 50. Once the burner 36 is fired, the control unit 26 will turn off the burner 36 when the boiler water temperature is at or above the lower temperature limit. In the same manner, as discussed with the upper temperature limit, if the differential jumper is removed, the water temperature will fall 30° F. below the lower temperature limit before the burner 36 is fired.

In the standard operating mode, when the priority aquastat 58 calls for heat, the hydronic control unit 26 will deactivate the circulating pump 18 and activate the burner 36 until the water temperature reaches the upper temperature limit. Once the temperature of the water in the boiler 14 reaches the upper temperature limit, the hydronic control unit 26 turns on the priority circulating pump 64 to direct the entire supply of heated water from boiler 14 to the priority zone until the priority demand is satisfied. Once the priority demand is satisfied, the hydronic control unit 26 again turns on the circulating pump 18 until the demand for heat from any of the room thermostats 30 is satisfied.

After receiving the priority demand from the priority aquastat 58, the hydronic control unit 26 monitors the priority zone and automatically turns on the circulating pump 18 after a predetermined amount of time if there is a malfunction in the indirect water heater 56. In the preferred embodiment of the invention, the hydronic control unit 26 monitors the priority zone and turns on the circulating pump 18 after one hour of delay if a malfunction is detected in the indirect water heater 56. In this manner, the hydronic control unit 26 prevents freeze-up by restoring heated water from the boiler 14 to the heating zones in the event of a malfunction in the indirect hot water heater 56.

In the standard operating mode, the hydronic control unit 26 has a warm weather cut-out feature available. The warm weather cut-out feature is activated when a warm weather switch 78 is in the rightmost position, opposite the position shown in FIG. 2. A warm weather cut-out temperature dial 80 is also included on the display face 42 of the hydronic control unit 26. The warm weather cut-out temperature dial 80 allows the homeowner to select an outside temperature at which the circulating pump 18 will not be activated by the hydronic control unit 26 thus preventing heating of the house 12. Once an appropriate outside temperature is selected, the hydronic control unit 26 will conserve energy by no longer circulating the heated water to the room heating zones when the outside temperature exceeds the temperature set on cut-out temperature dial 80. In the preferred embodiment of the invention, the warm weather cut-out temperature dial 80 includes the temperatures 40° F., 50° F., 60° F., 70° F. and 80° F. As previously discussed, the outside temperature is measured by the outdoor air sensor 68. Thus, if the outdoor air temperature exceeds the value set by the warm weather cut-out temperature dial 80, the hydronic control unit 26 will not operate the circulating pump 18. However, the hydronic control unit 26 will still operate the burner 36 upon a demand from the priority aquastat 56, indicating that domestic hot water is required.

As previously mentioned, the hydronic control unit 26 can also operate in a boiler reset operating mode. To activate the boiler reset operating mode, the mode selection switch 76 is moved to its rightmost position from the standard mode position shown in FIG. 2. In the boiler reset operating mode, the hydronic control unit 26 will automatically readjust the boiler setpoint temperature, which is the upper temperature limit at which the boiler 14 operates, based on changes in the outdoor air temperature as sensed by the outdoor air sensor 68. The boiler setpoint temperature can be adjusted by the hydronic control unit in three separate ratios determined by a ratio adjustment switch 82. The ratio adjustment switch 82 is a three-position switch which allows the reset ratio to be either 1:1, 2:1 or 0.5:1. A 1:1 ratio means that for every one degree change in the outdoor temperature, the boiler set point temperature will change 1° F. in the opposite direction. Thus, if the outdoor temperature increases by 1° F., the boiler set point temperature will decrease by 1° F. A 2:1 ratio means that for every 2° F. the outdoor temperature changes, the boiler water temperature will be changed 1° F. in the opposite direction. A 0.5:1 ratio means that for every 0.5° F. the outdoor temperature changes, the boiler water temperature will change 1° F. in the opposite direction. The advantage of the boiler reset operating mode is that as the outdoor temperature increases, the demand for heat in the house 12 decreases and the boiler 14 no longer needs to maintain the temperature of the water at as high a level. Thus, the boiler reset operating mode allows the boiler 14 to be operated in a more efficient manner.

The boiler set point temperature in the boiler reset operating mode is controlled by a reset temperature dial 84. In the preferred embodiment of the invention, the reset temperature dial 84 has five settings, 120° F., 160° F., 180° F., 200° F. and 220° F. The boiler set point temperature is determined as follows. First, the user must determine the worst case outdoor conditions for the geographic area of the house 12 in which the boiler 14 is installed. For instance, in far northern climates, the worst case outdoor temperature could be −20° F. Next, the user determines the maximum hot water supply temperature required to satisfy the heating requirement for the worst case outdoor condition. For example, in a northern climate, at −20° F., the boiler may need to be heated to 200° F. to supply adequate heating. To arrive at the correct boiler set point temperature for reset temperature dial 84, the worst case outdoor temperature is added to the maximum hot water supply temperature to result in the setting for the reset temperature dial 84. For the example discussed previously, the reset temperature setting would be 180° F. (−20° F.+200° F.).

Once the reset temperature dial 84 has been set, the high limit dial 48 is set to the highest boiler temperature desired, and the low limit dial 50 is set to the lowest boiler temperature allowable (90° F. in the preferred embodiment). Like the standard control mode, the warm weather cut-out switch 78 can also be turned on, such that the circulating pump 18 will not be operated by the hydronic control unit 26 when the outside air temperature exceeds the value set by the warm weather cut-out temperature dial 80.

Finally, the hydronic control unit 26 can be operated in a cold start mode when there is no water heater, such as direct water heater 56, connected to hydronic control unit 26. When operating in the cold start mode, the hydronic control unit 26 will not maintain the boiler 14 at the lower temperature limit determined by the setting of low limit dial 50. Rather, the hydronic control unit 26 will only fire the burner 36 upon a call for heat from one of the room thermostats 30. To select the cold start mode, the low limit dial 50 is placed at its lowest setting, which is 90° F. in the preferred embodiment of the invention and the mode selection switch 76 is moved to the standard mode position shown in FIG. 2. If the differential jumper (not shown) has not been removed, the hydronic control unit 26 will maintain the boiler temperature at 90° F. However, if the differential jumper has been removed, the hydronic control unit 26 will allow the boiler 14 to drop to ambient temperatures.

Figure 6:
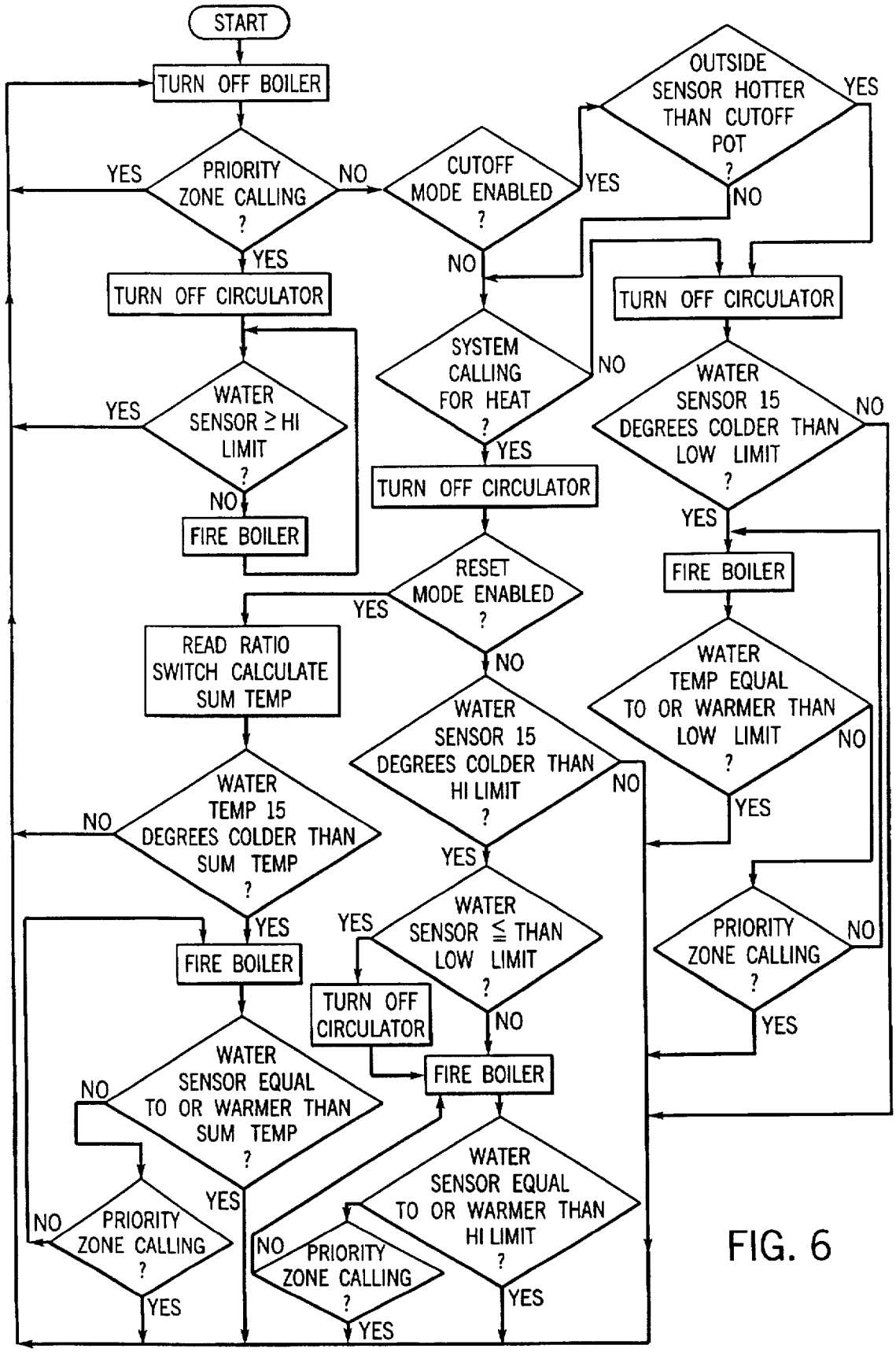
FIG. 6 is a flow diagram illustrating the operating logic of the hydronic control unit included in the hydronic heating system of the invention.

The hydronic control unit 26 contains a microprocessor which receives all of the input signals previously discussed and operates the hydronic heating system 10 in the manner described. The flow logic diagram for the microprocessor contained in the hydronic control unit 26 is shown in FIG. 6. As can be seen in this figure, the first step is for the hydronic control unit 26 to turn "off" the burner 36. The hydronic control unit 26 then determines whether the priority aquastat 58 is calling for heat. If the priority zone is calling for heat, the hydronic control unit 26 turns off the circulating pump 16. Next, the hydronic control unit 26 determines if the boiler water temperature is greater than or equal to the upper temperature limit set by the high limit dial 48. If the boiler water temperature exceeds the upper temperature limit, the hydronic control unit turns "on" the priority circulating pump 64 until the demand for heat is met. If not, the burner 36 is fired to raise the boiler water temperature. Once the water reaches the upper limit, the burner 36 is again turned "off" and priority circulating pump 64 is operated.

Once the priority zone is satisfied, the hydronic control unit 26 checks the warm weather switch 78. If the warm weather switch 78 is turned "on", the hydronic control unit 26 compares the outside temperature from outdoor air sensor 68 to the temperature setting of warm weather cut-out temperature dial 80. If the outside temperature exceeds the setting of the warm weather cut-out temperature dial 80, the circulating pump 18 is held "off" and the boiler water temperature is compared to the lower temperature limit set by low limit dial 50. If the boiler water temperature is more than 15° F. colder than the lower temperature limit, the burner 36 is fired until the boiler water temperature reaches the lower temperature limit.

If the warm weather cut-out feature is not enabled, the hydronic control unit 26 checks to see if any of the room thermostats 30 are calling for heat. If one of the room thermostats 30 is calling for heat, the hydronic control unit 26 turns on the circulating pump 18. Next, the hydronic control unit 26 checks to see if the boiler reset mode is enabled through the positioning of the mode selection switch 76. If the boiler reset mode is enabled, the hydronic control unit 26 reads the set ratio adjustment switch 82 and determines a new set point temperature. Once the new set point temperature is determined, the temperature of the water in the boiler is compared to the new set point temperature. If the boiler water temperature is 15° F. colder than the new set point temperature, the boiler is fired until the boiler water temperature reaches the new set point temperature.

If the boiler reset mode was not enabled, the hydronic control unit 26 operates in the standard mode and determines if the boiler water temperature is more than 15° F. colder than the upper temperature limit set by the high limit dial 48. If the boiler temperature is more than 15° F. colder than the upper limit, the hydronic control unit 26 then checks to see if the boiler water temperature is less than or equal to the lower limit. If the boiler water temperature is below the lower limit, the hydronic control unit 26 turns "off" the circulating pump 18 to prevent the circulation of cold water throughout the house 12. Next, the hydronic control unit 26 fires the burner 36 until the water in the boiler 14 reaches the upper limit, at which time the heated water will be circulated.

The operation of the microprocessor in the hydronic control unit 26 is terminated if the low water cut-off probe 54 senses a reduced amount of water in the hydronic heating system. In this case, the low water cut-off probe 54 opens a switch which prevents power from being supplied to the microprocessor or any of the remaining components in the hydronic control unit 26. In this manner, the low water cut-off probe 54 act as a safety device which prevents the operation of burner 36 upon problems in the hydronic heating system 10.

It is understood that the part numbers, components, temperature settings and other details of the system as described are for illustrative purposes only, and may be replaced by other comparable parts, settings, etc. It is also recognized that other equivalents, alternatives, or modifications aside from those expressly stated are possible and within the scope of the appended claims.

We claim:

1. A hydronic heating system including a main boiler and a circulating pump, the hydronic heating system heating a plurality of heating zones, the system comprising:

a plurality of zone thermostats, each thermostat in communication with one of the heating zones, the zone thermostats each generating a demand signal upon sensing that the temperature in the heating zone is below a desired value;

a plurality of zone valves, each zone valve being positioned between the main boiler and one of the heating zones, the operation of each zone valve controlling the flow of heated water from the main boiler to the heating zone;

a hydronic control unit in communication with the plurality of zone thermostats and zone valves, the hydronic control unit operating the zone valves to control the flow of heated water from the main boiler into each heating zone, the hydronic control unit further being in communication with the main boiler to maintain the boiler water temperature at a desired boiler temperature;

a priority device in communication with the hydronic control unit, the hydronic control unit diverting the flow of heated water from the boiler to only the priority device upon receiving a demand signal from the priority device, the hydronic control unit monitoring the priority device and restoring the flow of heated water to the zone valves after a predetermined delay during which heated water is diverted only to the priority device;

an outdoor temperature sensor in communication with the hydronic control unit;

a low water sensor in communication with the hydronic control unit the low water sensor disabling the hydronic control unit upon sensing a reduced amount of water in the hydronic heating system; and a mode selection switch, the mode selection switch selecting from a standard operating mode and a boiler reset operating mode, wherein when the standard operating mode is selected, the hydronic control unit maintains the boiler water temperature between an upper and a lower temperature limit, and wherein when the boiler reset operating mode is selected the hydronic control unit modifies the desired boiler temperature based on the outside air temperature.

2. A hydronic heating system including a main boiler and a circulating pump, the hydronic heating system heating a plurality of heating zones and a domestic hot water heater, the system comprising:

a plurality of zone thermostats, each thermostat in communication with one of the heating zones, the zone thermostats each generating a demand signal upon sensing that the temperature in the heating zone is below a desired value;

a plurality of zone valves, each zone valve being positioned between the main boiler and one of the heating zones, the operation of each zone valve controlling the flow of heated water from the main boiler to the heating zone;

a hydronic control unit in communication with the plurality of zone thermostats and zone valves, the hydronic control unit operating the zone valves to control the flow of heated water from the boiler into each heating zone, the hydronic control unit further being in communication with the boiler to maintain the boiler water temperature at a desired boiler temperature;

a priority device in communication with the hydronic control unit and the domestic hot water heater, the hydronic control unit diverting the flow of heated water from the boiler to only the priority device upon receiving a demand signal from the priority device;

an outdoor temperature sensor in communication with the hydronic control unit, the hydronic control unit modifying the desired boiler temperature based on the outside temperature; and a low water sensor in communication with the hydronic control unit, the low water sensor disabling the hydronic control unit upon sensing a reduced water amount in the hydronic heating system.

3. The heating system of claim 2 further comprising a ratio adjustment switch operable between a plurality of positions, the ratio adjustment switch being in communication with the hydronic control unit for adjusting the desired boiler temperature in relation to the outside temperature depending on the position of the ratio adjustment switch.

4. The heating system of claim 2 further comprising a boiler water sensor positioned to measure the temperature of the water in the boiler, the boiler water sensor being in communication with the hydronic control unit, wherein the boiler water sensor includes a mechanical relay which is operable to disable the boiler when the boiler water temperature exceeds a predetermined limit.

5. The heating system of claim 2 wherein the hydronic control unit disables the flow of heated water to the heating zones when the outside temperature exceeds a selected value.

6. A hydronic heating system including a main boiler and a circulating pump, the hydronic heating system heating a plurality of heating zones and a hot water heater, the system comprising:

a plurality of zone thermostats, each thermostat in communication with one of the heating zones, the zone thermostats each generating a demand signal upon sensing that the temperature in the heating zone is below a desired value;

a zone valve positioned between the main boiler and each one of the heating zones, the operation of each zone valve controlling the flow of heated water from the main boiler to the heating zone;

a hydronic control unit in communication with the plurality of zone thermostats and zone valves, the hydronic control unit operating the zone valves to control the flow of heated water from the boiler into each heating zone, the hydronic control unit further being in communication with the boiler to maintain the boiler water temperature at a desired boiler temperature;

a priority device in communication with the hydronic control unit and the hot water heater, the hydronic control unit diverting the flow of heated water from the boiler to only the priority device upon receiving a demand signal from the priority device, the hydronic control unit monitoring the priority device after receiving a demand signal from the priority device, such that the hydronic control unit restores the flow of heated water to the zone valves after a predetermined delay upon detection of a malfunction in the priority device during which heated water is directed only to the priority device:

an outside temperature sensor in communication with the hydronic control unit, the hydronic control unit modifying the desired boiler temperature based on the outside temperature; and a low water sensor in communication with the hydronic control unit, the low water sensor disabling the hydronic control unit upon sensing a reduced water amount in the hydronic heating system.

7. A self-contained control unit for a hydronic heating system for a plurality of heating zones each having a zone valve, the heating system having a main boiler and a circulating pump, the control unit comprising:

a microprocessor controller;

a single power connection for providing electric power to the control unit;

a burner terminal in communication with the microprocessor controller, the microprocessor activating the boiler to control the boiler water temperature through the burner terminal;

a series of heating zone terminals in communication with the microprocessor controller, the microprocessor controller controlling the operation of the zone valves through the heating zone terminals to direct the flow of heated water from the boiler to the desired heating zones;

a circulating pump terminal in communication with the microprocessor controller, the microprocessor controller controlling the operation of the circulating pump through the circulating pump terminal;

a priority zone terminal in communication with the microprocessor, the microprocessor controller diverting the flow of heated water from the boiler to the priority zone upon receiving a demand signal at the priority zone terminal; and a hot water sensor terminal in communication with the microprocessor controller, the microprocessor controller receiving the boiler water temperature through the hot water sensor terminal.

8. The control unit of claim 7 further comprising an outdoor air sensor terminal in communication with the microprocessor controller, a microprocessor controller receiving the outside temperature through the outside air terminal.

9. The control unit of claim 7 further comprising a safety terminal, the safety terminal being positioned to disrupt the supply of power from the singe power connection to the control unit upon receiving a cut-off signal at the safety terminal.

10. The control unit of claim 7 wherein the series of heating zone terminals includes a room thermostat terminal and a zone valve terminal.

11. The control unit of claim 7 further comprising a cold start selector in communication with the microprocessor controller, wherein upon activation of the cold start selector, the microprocessor controller permits the boiler water temperature to fall below a lower temperature limit.

12. A method of controlling the operation of a hydronic heating system for a plurality of heating zones, the hydronic heating system including a main boiler and a circulating pump, the method comprising the steps of:

providing a single hydronic control unit;

setting a desired boiler temperature in the hydronic control unit for water in the boiler;

maintaining the water in the boiler at the desired boiler temperature;

monitoring for a demand signal from any of the plurality of heating zones, the demand signal being received in the hydronic control unit only when the heating zone requires heat;

providing heated water from the boiler to each heating zone which is generating a demand signal;

positioning a sensor to determine the outside air temperature;

modifying the desired boiler temperature in the hydronic control unit based on the outside air temperature;

designating one of the heating zones as a priority zone;

diverting all of the heated water from the boiler to the priority zone upon demand for heat from the priority zone;

sensing the amount of water in the hydronic heating system and deactivating the hydronic control unit when the amount of water falls below a selected value; and deactivating the circulating pump when the outside temperature exceeds a warm weather cut-out value.

13. The method of claim 12 further comprising the steps of:

selecting an upper and a lower limit in the hydronic control unit for the boiler water temperature, the desired boiler temperature being in a range defined by the upper and lower limits; and p1 activating the boiler when the temperature of the water in the boiler falls below the lower limit and deactivating the boiler when the temperature of the water in the boiler reaches the upper limit.

14. The method of claim 13 further comprising the step of allowing the boiler water temperature to fall to a cold start value below the lower limit and activating the boiler only when the hydronic control unit receives a demand for heat from one of the plurality of heating zones.

15. The method of claim 13 wherein the range defined by the upper and lower temperature limits is adjustable.

16. The method of claim 12 wherein the step of modifying the desired temperature includes the step of setting a reset ratio such that the desired boiler temperature changes with the outside temperature based on the reset ratio.

17. The method of claim 12 wherein a domestic water heater is connected to the priority zone.

18. A method of controlling the operation of a hydronic heating system for a plurality of heating zones, the hydronic heating system including a main boiler, a circulating pump, and a domestic water heater, the method comprising the steps of:

providing a hydronic control unit;

setting a desired boiler temperature in the hydronic control unit for the water in the boiler;

setting an upper and a lower temperature limit in the hydronic control unit for the boiler water temperature;

monitoring for a demand signal from any of the plurality of heating zones, the demand signal being received in the hydronic control unit only when the heating zone requires heat;

providing heated water from the boiler to each heating zone which is generating a demand signal;

providing an outdoor air sensor in communication with the hydronic control unit to determine the outside air temperature;

designating one of the heating zones as a priority zone;

diverting all of the heated water from the boiler to the priority zone upon a demand for heat from the priority zone;

sensing the amount of water in the hydronic heating system and deactivating the hydronic control unit when the amount of water falls below a selected value;

deactivating the circulating pump when the outside air temperature exceeds a warm weather cut-out value; and selecting a hydronic control unit operating mode from a standard operating mode and a boiler reset operating mode, wherein when the standard operating mode is selected, the hydronic control unit maintains the boiler water temperature between the upper and lower temperature limits, and wherein when the boiler reset operating mode is selected, the hydronic control unit modifies the desired boiler temperature based on the outside air temperature.

19. In a hydronic heating system including a main boiler, a series of heat demand generators and a circulation system for circulating heated water from the boiler to the heat demand generators, the improvement comprising:

a processor-based controller for controlling operation of the hydronic heating system;

a power supply for supplying power to the processor-based controller; and a series of control connections at the processor-based controller distant from the power supply for interconnecting the processor-based controller with the boiler, the heat demand generators and the circulation system, for receiving reports as to operation of the boiler and as to demand for heated water from the heat demand generators and for providing outputs to the boiler and to the circulation system in response thereto.

20. A hydronic heating system including a main boiler and a circulating pump, the hydronic heating system heating a plurality of heating zones and a hot water heater, the system comprising:

a plurality of zone thermostats, each thermostat in communication with one of the heating zones, the zone thermostats each generating a demand signal upon sensing that the temperature in the heating zone is below a desired value;

a zone valve positioned between the main boiler and each one of the heating zones, the operation of each zone valve controlling the flow of heated water from the main boiler to the heating zone;

a hydronic control unit in communication with the plurality of zone thermostats and zone valves, the hydronic control unit operating the zone valves to control the flow of heated water from the boiler into each heating zone, the hydronic control unit further being in communication with the boiler to maintain the boiler water temperature at a desired boiler temperature;

a priority device in communication with the hydronic control unit and the domestic hot water heater, the hydronic control unit diverting the flow of heated water from the boiler to only the priority device upon receiving a demand signal from the priority device; and a boiler water sensor positioned to monitor the temperature of the water in the boiler, wherein the boiler water sensor disables the boiler when the boiler water temperature exceeds a predetermined limit.

21. The heating system of claim 20 wherein the boiler water sensor includes a mechanical relay device, the relay device being operated to disrupt power to the boiler when the boiler water temperature exceeds the predetermined limit.

22. The heating system of claim 21 further comprising a low water sensor in communication with the hydronic control unit, the low water sensor disabling the hydronic control unit upon sensing a reduced water amount in the hydronic heating system.

23. The heating system of claim 22 wherein the hydronic control unit monitors the priority device after receiving a demand signal from the priority device, such that the hydronic control unit restores the flow of heated water to the zone valves after a predetermined delay during which heated water is directed only to the priority device.

24. A hydronic heating system including a main boiler and a circulating pump, the hydronic heating system heating a plurality of heating zones and a domestic hot water heater, the system comprising:

a plurality of zone thermostats, each thermostat in communication with at least one of the heating zones, each zone thermostat generating a demand signal upon sensing that the temperature in the heating zone is below a desired value;

a plurality of zone valves, each zone valve being positioned between the main boiler and one of the heating zones, the operation of each zone valve controlling the flow of heated water from the main boiler to the heating zone;

a hydronic control unit in communication with the plurality of zone thermostats and zone valves, the hydronic control unit operating the zone valves to control the flow of heated water from the boiler into each heating zone, the hydronic control unit further being in communication with the boiler to maintain the boiler water temperature at a desired boiler temperature;

a priority device in communication with the hydronic control unit and the domestic hot water heater, the hydronic control unit diverting the flow of heated water from the boiler to only the priority device upon receiving a demand signal from the priority device, the hydronic control unit monitoring the priority device after receiving a demand signal from the priority device, such that the hydronic control unit restores the flow of heated water to the zone valves after a predetermined delay during which heated water is directed only to the priority device.

* * * * *

UNITED STATES PATENT AND TRADEMARK OFFICE

CERTIFICATE OF CORRECTION

PATENT NO. : 5,779,143

DATED : July 14, 1998

INVENTOR(S) : ROGER P. MICHAUD

It is certified that error appears in the above-indentified patent and that said Letters Patent is hereby corrected as shown below:

Claim 8, column 14, line 36, delete "a" and substitute therefor -- the --; Claim 13, column 15, line 20, after "and" delete "p1" and insert a new paragraph.

Signed and Sealed this

Fifteenth Day of June, 1999

*Attest:*

Q. TODD DICKINSON

*Attesting Officer*

*Acting Commissioner of Patents and Trademarks*